US008504253B2

(12) United States Patent
Stantchev et al.

(10) Patent No.: US 8,504,253 B2
(45) Date of Patent: Aug. 6, 2013

(54) DEVICE FOR CONTROLLING THE MOVEMENT OF A LOAD SUSPENDED FROM A CRANE

(75) Inventors: Pentcho Stantchev, Fourqueux (FR); Dobromir Valachev, Gabrovo (BG)

(73) Assignee: Schneider Toshiba Inverter Europe SAS, Pacy sur Eure (FR)

( * ) Notice: Subject to any disclaimer, the term of this patent is extended or adjusted under 35 U.S.C. 154(b) by 294 days.

(21) Appl. No.: 13/128,768

(22) PCT Filed: Dec. 14, 2009

(86) PCT No.: PCT/EP2009/067008

§ 371 (c)(1),
(2), (4) Date: May 11, 2011

(87) PCT Pub. No.: WO2010/069890

PCT Pub. Date: Jun. 24, 2010

(65) Prior Publication Data

US 2011/0218714 A1 Sep. 8, 2011

(30) Foreign Application Priority Data

Dec. 15, 2008 (FR) ..... 08 58598

(51) Int. Cl.
*B66C 13/06* (2006.01)

(52) U.S. Cl.
CPC ..... *B66C 13/063* (2013.01)
USPC ..... 701/50; 212/273

(58) Field of Classification Search
USPC ..... 701/50
See application file for complete search history.

(56) References Cited

U.S. PATENT DOCUMENTS

| | | | | |
|---|---|---|---|---|
| 2,188,686 | A * | 1/1940 | Kersting et al. | 212/260 |
| 2,589,172 | A * | 3/1952 | Wagner | 212/256 |
| 2,805,781 | A * | 9/1957 | Senn | 212/274 |
| 3,148,548 | A * | 9/1964 | Jones | 73/503 |

(Continued)

FOREIGN PATENT DOCUMENTS

| | | |
|---|---|---|
| DE | 195 19 368 | 11/1996 |
| FR | 2 923 818 | 5/2009 |

(Continued)

OTHER PUBLICATIONS

Sadati, N.; et al. "Design of a Gain-Scheduling Anti-Swing Controller for Tower Cranes Using Fuzzy Clustering Techniques." International Conference on Computational Intelligence for Modelling, Control and Automation, 2006 and International Conference on Intelligent Agents, Web Technologies and Internet Commerce. Total of 6 pages. XP 31002802 (Nov. 1, 2006).

(Continued)

*Primary Examiner* — Shelley Chen
(74) *Attorney, Agent, or Firm* — Oblon, Spivak, McClelland, Maier & Neustadt, L.L.P.

(57) ABSTRACT

A device for controlling movement of a load suspended by cables from a hook point that is rotatable about a vertical axis and movable translationally along an axis of translation, the movement of rotation generating a first or sway angle of the load relative to the axis of translation. The device calculates the first or sway angle and a speed of the first or sway angle, the only input variables used being the length of the cables, the distance between the axis of rotation and the hook point, and the speed of rotation of the hook point, while the acceleration of the first or sway angle is used as an internal variable.

22 Claims, 1 Drawing Sheet

U.S. PATENT DOCUMENTS

Figure 1:
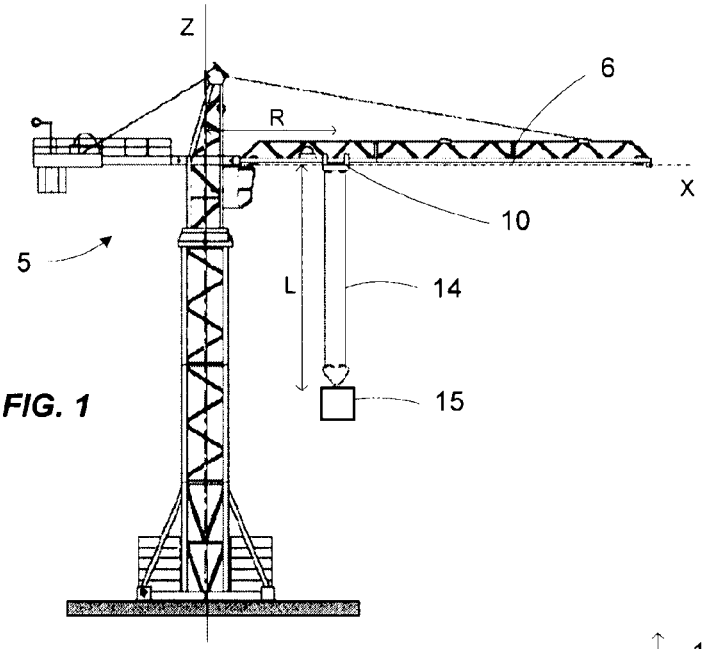

| | | | | | |
|---|---|---|---|---|---|
| 3,351,213 | A | * | 11/1967 | Newman et al. | 212/275 |
| 4,717,029 | A | * | 1/1988 | Yasunobu et al. | 212/275 |
| 5,217,126 | A | * | 6/1993 | Hayashi et al. | 212/277 |
| 5,219,420 | A | | 6/1993 | Kiiski et al. | |
| 5,251,768 | A | * | 10/1993 | Yoshimatsu et al. | 212/277 |
| 5,272,877 | A | * | 12/1993 | Fukushima et al. | 60/327 |
| 5,550,733 | A | * | 8/1996 | Yun et al. | 700/69 |
| 6,072,127 | A | * | 6/2000 | Oslakovic | 177/136 |
| 6,170,681 | B1 | * | 1/2001 | Yoshimatsu | 212/278 |
| 8,025,167 | B2 | * | 9/2011 | Schneider et al. | 212/273 |
| 2004/0164041 | A1 | * | 8/2004 | Sawodny et al. | 212/273 |
| 2007/0289931 | A1 | * | 12/2007 | Henriksson | 212/274 |
| 2008/0282583 | A1 | * | 11/2008 | Koellner et al. | 37/348 |
| 2009/0057964 | A1 | * | 3/2009 | Colavito et al. | 266/44 |

FOREIGN PATENT DOCUMENTS

| | | | | |
|---|---|---|---|---|
| JP | 03018596 | A | * | 1/1991 |
| JP | 05319779 | A | * | 12/1993 |
| JP | 11060154 | A | * | 3/1999 |
| JP | 2000219482 | A | * | 8/2000 |

OTHER PUBLICATIONS

Jerman, B.; et al. "A study of the horizontal inertial forces acting on the suspended load of slewing cranes." International Journal of Mechanical Sciences, vol. 50, No. 3. pp. 490-500, XP 22511039 (Mar. 1, 2008).

Yang, W.; et al. "Modeling of system dynamics of a slewing flexible beam with moving payload pendulum." Mechanics Research Communications, vol. 34, No. 3. pp. 260-266, XP 22002246 (Mar. 27, 2007).

International Search Report issued Mar. 25, 2010 in PCT/EP09/67008 filed Dec. 14, 2009.

* cited by examiner

DEVICE FOR CONTROLLING THE MOVEMENT OF A LOAD SUSPENDED FROM A CRANE

The present invention relates to a device and a method for controlling the movement of a load suspended by cables from a hoisting machine, this hoisting machine being capable of driving the load in a rotation movement.

The hoisting machines in question notably relate to various types of tower crane or jib crane. These cranes comprise a jib which is attached to the top of a vertical mast. The jib has a suspension point (or hook point) from which the load is suspended by suspension cables. One particular feature of these cranes is the performance of a first movement which is a rotation or slewing movement of the jib about a vertical rotation axis Z which is generally centered on the mast of the crane.

Furthermore, these cranes perform a second movement which is a linear movement from the suspension point along the jib, this second movement being referred to as translation movement in the present document. In certain cranes, the suspension point of the load is a trolley which is mobile in translation on rails, the translation movement (trolley movement) then being performed along the horizontal axis X of the jib. Other cranes comprise a luffing jib or one which is articulated (jack-knife jib) and at the end of which the suspension point of the load is disposed. The raising/lowering or the articulation of the jib then creates the translation movement of the suspension point.

In addition, the cranes always comprise a device for hoisting the load which is associated with the suspension cables, whose length is variable so as to allow the load to be displaced vertically in a third movement referred to as hoisting movement.

The handling of a load by a hoisting machine leads to a sway motion of this load which it is obviously desirable to damp in order to carry out the transfer of the load smoothly and in complete safety and in the shortest possible period of time. In the case of a crane, a first sway motion is generated by the rotation movement about the vertical rotation axis Z. A second sway motion is also generated by the acceleration/deceleration of the translation movement along the translation axis X.

In contrast to a sway motion due to a linear movement, the particularity of a sway motion due to a rotation movement is that this motion possesses a component which is generated by the centrifugal force of the load during the rotation movement, this force tending to sway the load away from the area of rotation. It is not, therefore, possible to eliminate the first sway motion by acting solely on the controls of this rotation movement. Moreover, one feature of the first sway motion is that it remains present whenever the rotational speed is non-zero, even when the acceleration or the deceleration of the rotation movement is zero.

Several solutions already exist for automatically decreasing the sway angle generated by a translation movement of a suspended load along a horizontal axis, notably in the documents FR2698344, FR2775678, U.S. Pat. No. 5,443,566. However, none of these documents deals with an anti-sway device capable of automatically controlling the sway angle generated by a rotation movement of the load about a vertical rotation axis.

For this reason, the aim of the invention is to control the oscillations of a load suspended from a crane, using a device and a method that is simple, quick and easy to implement. It allows the measurements or information sampling necessary to implement the control of the sway of a load to be minimized.

For this purpose, the invention describes a device for controlling the movement of a load suspended by suspension cables from a suspension point of a hoisting machine, the suspension point being capable of performing a rotation movement about a vertical rotation axis and a translation movement along a translation axis, the rotation movement generating a first sway angle of the load along the translation axis. The control device comprises means for calculating the first sway angle and a speed of the first sway angle, using as the only input variables information representative of a length of the suspension cables, information representative of a distance between the rotation axis and the suspension point and information representative of a rotation speed of the suspension point, and using as internal variable an acceleration of the first sway angle. The calculation means determine the first sway angle and the speed of the first sway angle by means of an iterative process using the acceleration of the first sway angle.

According to one feature, the calculation means determine the first sway angle of the load by also taking into account the translation movement made by the suspension point along the translation axis.

According to another feature, the information representative of the rotation speed of the suspension point is determined using a reference speed which is supplied to a variable speed drive controlling the rotation movement of the suspension point. As an alternative, the information representative of the rotation speed of the suspension point is determined using a speed estimation which is generated by a variable speed drive controlling the rotation movement of the suspension point.

According to another feature, the control device calculates an offset value of the first sway angle which is a function of the rotation speed of the suspension point and delivers a first correction signal for the speed of the translation movement of the suspension point which takes into account the offset value. The first correction signal is proportional to the difference between the first sway angle and the offset value and is proportional to the speed of the first sway angle.

According to another feature, the first correction signal is added to a speed setpoint in order to supply a speed reference for the translation movement of the suspension point, the first correction signal being calculated by applying a correction coefficient to the difference between the first sway angle ($\Theta x$) and the offset value and to the speed of the first sway angle. The correction coefficients can vary as a function of the length of the suspension cables.

According to another feature, the calculation means calculate a second sway angle of the load along a tangential axis perpendicular to the translation axis and a speed of the second sway angle, by means of an iterative process and using as the only input variables the information representative of the length, the information representative of the distance and the information representative of the rotation speed, and using as internal variable an acceleration of the second sway angle.

The invention also claims an automation control system designed to control the movement of a load suspended by suspension cables from a suspension point of a hoisting machine and comprising such a control device. Similarly, the invention claims a method for controlling the movement of a suspended load which is implemented within such a control device.

Figure 2:
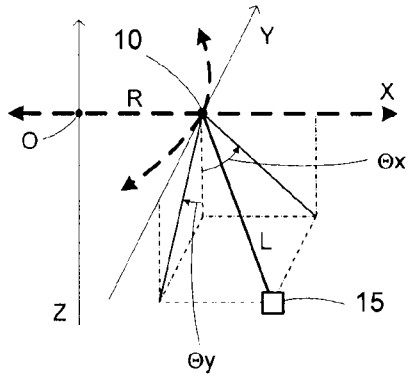
Figure 3:
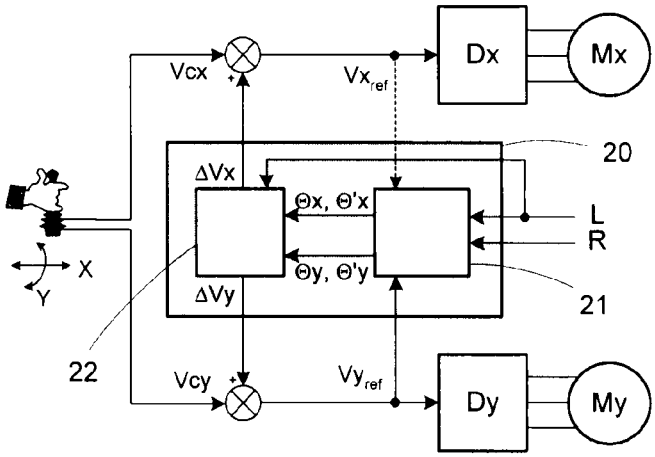

Other features and advantages will become apparent in the detailed description that follows referring to one embodiment presented by way of example and represented by the appended drawings, in which:

FIG. 1 shows one example of a hoisting machine, of the crane type, comprising a rotation movement about a vertical axis, FIG. 2 shows a schematic representation of the sway angles of a load suspended from a suspension point in such a hoisting machine, FIG. 3 shows a simplified diagram of a device for controlling the movement of a load according to the invention.

The device for controlling the movement of a suspended load according to the invention can be implemented in a hoisting machine comprising a rotation movement of the load, such as a crane or similar. The example in FIG. 1 shows a crane 5 which comprises a vertical mast and a substantially horizontal jib 6. The jib 6 comprises a suspension point 10, which can be a mobile trolley such as in the example in FIG. 1. The jib 6 can perform a rotation movement about a vertical rotation axis Z running through the vertical mast of the crane 5. The suspension point 10 is mobile along the jib 6 in order to perform a translation movement along a translation axis X. The translation axis X therefore crosses the rotation axis Z at a point O (see FIG. 2) and passes through the suspension point 10. In the example shown, the translation axis X is horizontal, but some cranes comprise a jib 6 having a non-zero angle with respect to the horizontal.

Furthermore, the crane 5 can perform a vertical hoisting movement in order to raise and lower a load 15 suspended by one or more suspension cables 14 which go through the suspension point 10 and with the end of which is associated a mechanism for suspending the load 15 to be moved.

With reference to FIG. 2, the suspension point 10 is situated at a distance R from the rotation axis Z (represented by the point O in FIG. 2), this distance R varying when the suspension point 10 is moved along the translation axis X. Under the action of the hoisting movement, the load 15 of course exhibits a suspension height that varies as a function of the length L of the suspension cables 14. In the following, this suspension height of the load will be considered equivalent to the length of the cables L, to which an offset might be added representing the distance between the lower end of the cables 14 and the load 15 (represented for example by its center of gravity).

During the rotation movement, the load 15 therefore moves along a virtual vertical cylinder centered on the vertical axis Z and of radius R, ignoring the sway. At any given moment, the rotational motion of the suspension point 10 therefore takes place along a mobile horizontal tangential axis Y which is always perpendicular to the translation axis X and tangent to the vertical cylinder.

When the suspension point 10 performs a rotation movement, the load 15 describes a pendulum-type motion referred to as sway which is defined by a sway angle having two orthogonal components. A first component forms the first sway angle denoted Θx and corresponds to the projection of the sway onto the translation axis X. A second component forms the second sway angle denoted Θy and corresponds to the projection of the sway onto the tangential axis Y. Furthermore, when the suspension point 10 performs a translation movement, the load 15 also describes a pendulum-type motion with a sway angle along the translation axis X only, which is added to the first sway angle Θx defined hereinabove.

The translation movement along the axis X is performed thanks to a translation motor Mx controlled by a variable speed drive Dx which receives a speed reference $Vx_{ref}$ (see FIG. 3). Similarly, the rotation movement about the vertical axis Z is performed thanks to a rotation motor My controlled by a variable speed drive Dy which receives an angular speed reference $Vy_{ref}$. The hoisting movement along the axis Z is performed thanks to a hoist motor, not shown in the figures, which allows the suspension cables to be wound and unwound. This hoist motor could be placed on the suspension point 10.

The translation and rotation movements are respectively controlled by the driver of the crane 5, this driver supplying a translation speed setpoint signal Vcx and a rotation speed setpoint signal Vcy, respectively, for example by means of a switch lever or levers—of the joystick type—as indicated in FIG. 3. Nevertheless, in certain applications where the hoisting machines were controlled automatically, it could also be conceived that the speed setpoints Vcx, Vcy come directly from an automation control unit.

Furthermore, in contrast to the linear movements, a rotation movement generates a sway whose angle exhibits non-zero components Θx and Θy in the two perpendicular axes X and Y, respectively. The second component Θy along the axis Y is generated by the acceleration/deceleration of the suspension point and can be defeated by acting on the control of the rotation movement. On the other hand, the first component Θx along the axis X is generated by the centrifugal force which causes a movement of the load 15 which is not directed in the tangential plane YZ, but which is directed along a perpendicular plane XZ. This first component Θx cannot therefore be defeated by acting on the control of the rotation movement, but involves also acting on the control of the translation movement along the axis X.

In addition, the centrifugal force causes the movement of the load 15 along the axis X, even when the rotation movement takes place at constant speed (in other words with zero acceleration/deceleration).

The aim of the invention is therefore to assist the control of the hoisting machine 5 capable of performing a translation movement and a rotation movement of the suspension point 10, these two movements being of course able to be carried out simultaneously. Similarly, the translation and rotation movements can be carried out simultaneously with a hoisting movement of the load 15 along the axis Z.

The nature of the sway generated by the rotation and the interaction between the various movements complicate the control of the sway and the control of the movement of the suspended load 15.

The invention allows the sway to be damped in a simple and automatic manner along the axis X and along the axis Y during the movement of the load 15 and in a manner that is transparent to the driver of the machine. Advantageously, the invention does not require any learning phase nor does it require any measurement of the sway angle Θx and/or Θy, of the motor current or of the motor torque which can become costly and more laborious to implement.

With reference to FIG. 3, the goal of a control device 20 is to damp the oscillating motion of the load 15 when it is moved in rotation and/or in translation, this movement being of course able to be carried out at the same time as a hoisting movement of the load 15.

The control device 20 comprises means for determining information representative of the length L of the suspension cables. These determination means comprise for example a sensor or encoder associated with the shaft of the hoist motor or with the winding drum of the cables. Other means for determining the length L are conceivable: for example, several limit switch sensors distributed over the entire run of the cables, the length L then being determined by predetermined level values as a function of the triggering of these limit switch sensors. This solution is nevertheless of course less accurate.

The control device 20 comprises means for determining information representative of the distance R between the suspension point 10 and the rotation axis Z. Various means of determination are possible:

According to a first variant, the distance R is obtained by means of a sensor which can be a rotating encoder associated with the shaft of the translation motor Mx or with the winding drum of the cables, or which can be an absolute encoder, for example a linear encoder of the potentiometer type along the jib 6.

According to a second variant, the distance R is obtained by integration starting from a measurement of the reference speed $Vx_{ref}$ of the translation movement, then by integration of this reference speed. The reference speed $Vx_{ref}$ is readily available because it is in fact used by the variable drive Dx responsible for controlling the translation motor Mx. One or more detectors, of the limit switch or proximity detector type, may additionally be used to provide reset values for R.

According to a third variant, the distance R can also be obtained by means of several detectors distributed over the whole run along the jib 6, the distance R then being determined by predetermined level values as a function of the triggering of these limit switch sensors. This solution is nevertheless of course less accurate.

The control device 20 also comprises means for determining information representative of the rotation speed Vy of the suspension point 10. Various determination means are possible:

According to a first variant, the rotation speed Vy is obtained by a measurement of the real rotation speed of the suspension point 10. This solution however requires the use of a speed or motion sensor.

According to a second variant, the rotation speed Vy is obtained directly by the speed reference $Vy_{ref}$ which is supplied to the input of the variable drive Dy responsible for controlling the rotation motor My. In this case, it is assumed that the variable drive Dy is able to follow the speed reference very quickly. This solution is very simple to implement since the speed reference $Vy_{ref}$ is readily available.

According to a third variant, the rotation speed Vy is obtained by a speed estimate generated in the variable speed drive Dy responsible for controlling the motor My. In some cases, this speed estimate is actually closer to the real speed than the speed reference $Vy_{ref}$ due to phenomena such as ramp following error or mechanical phenomena. This solution may therefore be advantageous notably for an application using a conical motor. The speed estimation parameter internal to the variable drive is often available at an analog output of the variable drive.

The control device 20 comprises an estimator module 21 connected to a corrector module 22. The estimator module 21 receives as input the information representative of the length L of the cables, of the distance R and of the rotation speed Vy and comprises calculation means that calculate, in real time, the first sway angle Θx and the speed (or variation) Θ'x of this first angle Θx, together with the second sway angle Θy and the speed (or variation) Θ'y of this second angle Θy. The estimator module 21 then transmits these calculated values to the corrector module 22 which calculates and delivers as output a first correction signal ΔVy which is added to the speed setpoint Vcy for the rotation movement, together with a second correction signal ΔVx which is added to the speed setpoint Vcx for the translation movement.

In order to calculate the sway angles Θx and Θy and the speeds Θ'x and Θ'y, the estimator module 21 uses a pendulum mathematical model with damping, which satisfies the following two equations:

$$L*\Theta''x=-g*\sin\Theta x-V'x*\cos\Theta x+Vy^2*(R+L*\sin\Theta x)*\cos\Theta x+(Vz-K_f)*\Theta'x \quad \text{a)}$$

$$L*\Theta''y=-g*\sin\Theta y-V'y*R*\cos\Theta y+Vy^2*L*\sin\Theta y*\cos\Theta y+(Vz-K_f)*\Theta'y \quad \text{b)}$$

in which:

Θx represents the first sway angle of the load along the axis X,

Θ'x represents the speed of the sway angle Θx,

Θ"x represents the acceleration of the sway angle Θx,

Θy represents the second sway angle of the load along the axis Y,

Θ'y represents the speed of the sway angle Θy,

Θ"y represents the acceleration of the sway angle Θy,

L represents the length of the cables,

R represents the distance between the suspension point of the cables and the rotation axis Z, Vz represents the speed of the hoisting movement, calculated as being the derivative of the length L, Vx represents the linear speed of the translation movement along the axis X, preferably calculated as being the derivative of the distance R, or measured using the reference speed $Vx_{ref}$ supplied at the input of the variable drive Dx responsible for controlling the rotation motor Mx (see dashed arrow in FIG. 3), V'x represents the acceleration of the translation movement along the axis X, calculated as being the derivative of the speed Vx, Vy represents the angular speed of the rotation movement of the suspension point 10, V'y represents the angular acceleration of the rotation movement, calculated as being the derivative of the speed Vy, $K_f$ represents a fixed coefficient of friction, g represents the force due to gravity.

The equation a) shows that the control device uses the acceleration Θ"x of the angle Θx as internal variable and that the only input variables supplied to the estimator module 21 are the length of the cables L, the distance R and the angular rotation speed Vy. The first sway angle Θx and the speed Θ'x are calculated by means of an iterative process over time, in other words the results are calculated periodically at each time t, notably using the results obtained at time t−1. This iterative process uses the acceleration Θ"x and may be represented at any time t in the following manner:

$$Vx_t=(R_t-R_{t-1})/\Delta t$$

$$V'x_t=(Vx_t-Vx_{t-1})/\Delta t$$

$$Vz_t=(L_t-L_{t-1})/\Delta t$$

$$\Theta''x_t=(-g*\sin\Theta x_t-V'x_t*\cos\Theta x_t+Vy_t^2*(R_t+L_t*\sin\Theta x_t)*\cos\Theta x_t+(Vz_t-K_f)*\Theta'x_t)/L_t$$

$$\Theta'x_t=\Theta'x_{t-1}+\Theta''x_{t-1}*\Delta t$$

$$\Theta x_t=\Theta x_{t-1}+\Theta'x_{t-1}*\Delta t$$

in which $\Theta x_t$ and $\Theta x_{t-1}$ represent the first sway angle at a time t and at a preceding time t−1, respectively, $\Theta'x_t$ and $\Theta'x_{t-1}$ represent the speed of the sway angle Θx at times t and t−1, respectively, $\Theta''x_t$ and $\Theta''x_{t-1}$ represent the acceleration of the sway angle $\Theta x$ at times t and t−1, respectively, $V'x_t$ represents the acceleration of the translation movement at time t, $Vx_t$ and $Vx_{t-1}$ represent the speed of the translation movement at times t and t−1, respectively, $Vz_t$ represents the hoisting speed at time t, $R_t$ and $R_{t-1}$ represent the distance R at times t and t−1, respectively, $Vy_t$ represents the rotation speed at time t, $L_t$ and $L_{t-1}$ represent the length of the cables at times t and t−1, respectively, and $\Delta t$ represents the time difference between time t and time t−1.

The iterative process starts from the assumption that, at the start, the values of $\Theta x$, $\Theta' x$ and $\Theta'' x$ are zero, in other words, at time t=0: $\Theta x_0=\Theta' x_0=\Theta'' x_0=0$.

Similarly, the equation b) shows that the control device uses the acceleration $\Theta''y$ of the angle $\Theta y$ as internal variable and that the only input variables supplied to the estimator module 21 are the length of the cables L, the distance R and the angular rotation speed Vy. The second sway angle $\Theta y$ and speed $\Theta' y$ are calculated by means of an iterative process over time, in other words the results are recalculated periodically at each time t, notably using the results obtained at the preceding time t−1. This iterative process uses the acceleration $\Theta''y$ and may be represented at any time t in the following manner:

$$V'y_t=(Vy_t-Vy_{t-1})/\Delta t$$

$$Vz_t=(L_t-L_{t-1})/\Delta t$$

$$\Theta''y_t=(-g*\sin\Theta y_t-V'y_t*R*\cos\Theta y_t+Vy_t^2*L_t*\sin\Theta y_t*\cos\Theta y_t+(Vz_t-K_f)*\Theta' y_t)/L_t$$

$$\Theta' y_t=\Theta' y_{t-1}+\Theta'' y_{t-1}*\Delta t$$

$$\Theta y_t=\Theta y_{t-1}+\Theta' y_{t-1}*\Delta t$$

in which $\Theta y_t$ and $\Theta y_{t-1}$ represent the second sway angle at a time t and at a preceding time t−1, respectively, $\Theta' y_t$ and $\Theta' y_{t-1}$ represent the speed of the sway angle $\Theta y$ at times t and t−1, respectively, $\Theta'' y_t$ and $\Theta'' y_{t-1}$ represent the acceleration of the angle $\Theta y$ at times t and t−1, respectively, $V'y_t$ represents the angular acceleration of the rotation movement at time t, $Vz_t$ represents the hoisting speed at time t, $Vy_t$ and $Vy_{t-1}$ represent the angular rotation speed at times t and t−1, respectively, $L_t$ and $L_{t-1}$ represent the length of the cables at times t and t−1, respectively, and $\Delta t$ represents the time difference between time t and time t−1.

The iterative process starts from the assumption that, at the start, the values of $\Theta y$, $\Theta' y$ and $\Theta'' y$ are zero, in other words, at time t=0: $\Theta y_0=\Theta' y_0=\Theta'' y_0=0$.

The equation a) comprises a specific term "$Vy^2*R*\cos\Theta x$" which is always positive when the rotation speed Vy is non-zero. This corresponds to the influence of the centrifugal force which means that, as soon as a rotation movement is underway (even with an acceleration V'y equal to zero), a first sway angle $\Theta x$ is created in the direction X, perpendicular to the tangential axis Y. The objective of the control is not therefore to cancel this sway during the rotation movement but only to reach an equilibrium position with a non-zero sway of the load 15 corresponding to a non-zero equilibrium angle during the rotation, then to return to a sway angle $\Theta x$ of zero at the end of the rotation movement, when the rotation speed Vy is zero. During the rotation movement, this equilibrium angle thus corresponds to an offset value, denoted $\Theta x_{eq}$. When the rotation movement is in progress, the idea is not to cancel this offset value $\Theta x_{eq}$, but to stabilize the load without oscillation with an inclination corresponding to the offset value $\Theta x_{eq}$. After approximation, the offset value $\Theta x_{eq}$ can be determined by the following equation ($\Theta x_{eq}$ expressed in radians):

$$\Theta x_{eq}=R*Vy^2/(g-L*Vy^2)$$

This equation clearly demonstrates that the offset value $\Theta x_{eq}$ is proportional to the rotation speed Vy and is zero when the rotation speed Vy is zero.

The corrector module 22 receives as input the calculated estimates of $\Theta x$, $\Theta y$, $\Theta' x$, $\Theta' y$ coming from the estimator module 21 and applies a correction coefficient $K_\Theta$ and $K'_\Theta$ to them, respectively, in order to supply the correction signals $\Delta Vx$ and $\Delta Vy$, according to the following equations:

$$\Delta Vx=K_{\Theta x}*(\Theta x-\Theta x_{eq})+K'_{\Theta x}*\Theta' x$$

$$\Delta Vy=K_{\Theta y}*\Theta y+K'_{\Theta y}*\Theta' y$$

in which $K_{\Theta x}$ and $K_{\Theta y}$ are correction coefficients respectively applied to the sway angles $\Theta x$ and $\Theta y$ for the translation and rotation movements, $K'_{\Theta x}$ and $K'_{\Theta y}$ are the correction coefficients respectively applied to the speeds of the sway angles $\Theta' x$ and $\Theta' y$ for the translation and rotation movements, $\Delta Vx$ and $\Delta Vy$ are the correction signals to be respectively applied to the speed setpoints Vcx and Vcy, and $\Theta x_{eq}$ is the offset value of the angle $\Theta x$ during the rotation movement.

The first correction signal $\Delta Vx$ therefore depends, not directly on the first sway angle $\Theta x$, but on the difference between the first sway angle $\Theta x$ and the offset value $\Theta x_{eq}$. Thus, when a rotation movement is in progress (speed $Vy_{ref}$ non-zero), the offset value $\Theta x_{eq}$ is non-zero and hence the control device 20 delivers a correction signal $\Delta Vx$ which takes into account the offset value generated by the centrifugal force on the sway angle $\Theta x$. When the rotation movement is stopped (speed $Vy_{ref}$ zero), the offset value $\Theta x_{eq}$ automatically becomes zero and the control device 20 then applies a correction signal $\Delta Vx$ which is proportional to $\Theta x$ and $\Theta' x$.

The speed reference $Vx_{ref}$ applied to the input of the variable drive Dx controlling the translation motor Mx is therefore equal to the speed setpoint for the translation movement Vcx coming from the automation system of the crane 5, augmented by the first correction signal $\Delta Vx$ delivered by the control device 20, in other words: $Vx_{ref}=Vcx+\Delta Vx$.

Similarly, the speed reference $Vy_{ref}$ applied to the input of the variable drive Dy controlling the rotation motor My is equal to the speed setpoint for the rotation movement Vcy coming from the automation system of the crane 5, augmented by the second correction signal $\Delta Vy$ delivered by the control device 20, in other words: $Vy_{ref}=Vcy+\Delta Vy$.

According to a first simplified embodiment, the values of the correction coefficients $K_\Theta$ and $K'_\Theta$ are fixed. According to a second preferred embodiment, the values of the correction coefficients $K_\Theta$, $K'_\Theta$ can be modified as a function of the length L of the cables determined by the device 20, in such a manner as to optimize the speed corrections to be applied according to the height of the pendulum formed by the load 15. In this case, the corrector module 22 receives as input information representative of the length L and is therefore capable of storing several values of $K_\Theta$, $K'_\Theta$ depending on the length L.

In a first situation, it is assumed that the automation system of the crane 5 only controls a rotation movement, in other words it supplies a translation speed setpoint Vcx that is zero. The rotation movement therefore generates a first sway angle $\Theta x$ along the translation axis X caused by the centrifugal force applied on the load 15, together with a second sway angle $\Theta y$ along the tangential axis Y caused by the acceleration/deceleration of the rotation movement. As previously indicated, the first sway angle can only be canceled by acting on the translation movement.

However, if no translation movement is requested by the automation system, the final position of the suspension point must be identical to its initial position, in other words the final distance R at the end of the rotation movement must be equal to the initial distance R at the start of the movement, whatever the corrections applied in translation to cancel the first sway angle Θx due to the rotation. For this reason, the corrector module 22 of the control device 20 stores the initial distance R and, at the end of the rotation movement, applies a suitable correction signal ΔVx in order to return the suspension point 10 to its initial position, in such a manner that $R_{final}=R_{initial}$.

In a second situation, the automation system of the crane 5 in addition controls a translation movement, in other words it also supplies a non-zero translation speed setpoint Vcx. This translation movement also creates a sway along the axis X caused by the acceleration/deceleration of the translation movement. The first sway angle Θx then represents the aggregation of the sway generated by the translation and the rotation movements.

Advantageously, the control device does not comprise any preliminary modeling step which would require other physical parameters to be measured such as a measurement of the sway angle or a measurement of the current flowing in the motor, with the aim of determining or refining a particular mathematical model or with the aim of establishing a transfer function between the speed of the trolley and the sway angle measured by a sensor for a given length of cables.

The control device thus described is designed to be installed in an automation system of the crane 5, which is responsible notably for controlling and monitoring the movements of the load 15. This automation system notably comprises a variable speed drive Dx for the translation movement and a variable speed drive Dy for the rotation movement. In view of its simplicity, the control device can be installed directly in the variable speed drives Dx and Dy, for example by means of a specific module of the variable drive. The automation system can also comprise a programmable logic controller which is notably used to supply the speed setpoints Vcx and Vcy. In this case, the control device can also easily be integrated into an application program of the programmable logic controller.

The control device implements a method for controlling the movement of the load 15 according to a rotation movement about the axis Z potentially associated with a translation movement along the axis X. The control method comprises a calculation step, carried out by the estimator module 21, which allows a first sway angle Θx and a speed Θ'x of this sway angle to be determined. The calculation step only uses the length L, the distance R and the rotation speed Vy of the suspension point 10 as input variables and uses the acceleration Θ"x as internal variable. The calculation step directly uses a pendulum model with damping.

The control method also comprises a correction step carried out by the corrector module 22. The correction step calculates an offset value $\Theta x_{eq}$ for the angle Θx which is proportional to the rotation speed Vy and delivers a first correction signal ΔVx for the translation speed which takes into account the offset value $\Theta x_{eq}$. The first correction signal ΔVx is calculated by applying a correction coefficient $K_{\Theta x}$ to the difference between the first sway angle Θx and the offset value $\Theta x_{eq}$ and a correction coefficient $K'_{\Theta x}$ to the speed Θ'x.

The invention claimed is:

1. A device for controlling movement of a load suspended by suspension cables from a suspension point of a hoisting machine, the suspension point being capable of performing a rotation movement about a vertical rotation axis and a translation movement along a translation axis, the rotation movement generating a first sway angle of the load along the translation axis, the control device comprising:

calculation means for determining the first sway angle and a speed of the first sway angle, using as only input variables information representative of a length of the suspension cables, information representative of a distance between the rotation axis and the suspension point, and information representative of a rotation speed of the suspension point, and using as an internal variable an acceleration of the first sway angle.

2. The control device as claimed in claim 1, wherein the calculation means determines the first sway angle and the speed of the first sway angle by an iterative process using the acceleration of the first sway angle.

3. The control device as claimed in claim 2, wherein the calculation means determines the first sway angle of the load by also taking into account translation movement made by the suspension point along the translation axis.

4. The control device as claimed in claim 2, wherein the control device calculates an offset value of the first sway angle which is a function of the rotation speed of the suspension point and delivers a first correction signal for the speed of the translation movement of the suspension point which takes into account the offset value.

5. The control device as claimed in claim 4, wherein the first correction signal is proportional to the difference between the first sway angle and the offset value and is proportional to the speed of the first sway angle.

6. The control device as claimed in claim 5, wherein the first correction signal is added to a speed setpoint to supply a speed reference for the translation movement of the suspension point, the first correction signal being calculated by applying a correction coefficient to the difference between the first sway angle and the offset value and to the speed of the first sway angle.

7. The control device as claimed in claim 6, wherein the correction coefficients are variable as a function of the length of the suspension cables of the load.

8. The control device as claimed in claim 4, wherein the calculation means calculates a second sway angle of the load along a tangential axis perpendicular to the translation axis and a speed of the second sway angle, using as the only input variables the information representative of a length, the information representative of a distance, and the information representative of the rotation speed, and using as an internal variable an acceleration of the second sway angle.

9. The control device as claimed in claim 8, wherein the calculation means determines the second sway angle and the speed of the second sway angle by an iterative process using the acceleration of the second sway angle.

10. The control device as claimed in claim 9, wherein the control device supplies a second correction signal for the rotation speed calculated by applying a correction coefficient to the second sway angle and to the speed of the second sway angle.

11. An automation system configured to control movement of a load suspended by suspension cables from a suspension point of a hoisting machine, wherein the automation system comprises a control device as claimed in claim 1.

12. A method for controlling movement of a load suspended by suspension cables from a suspension point of a hoisting machine, the suspension point being capable of performing a rotation movement about a vertical rotation axis and a translation movement along a translation axis, the rotation movement generating a first sway angle of the load along the translation axis, the method comprising:

a calculation that determines the first sway angle and a speed of the first sway angle, using as the only input variables information representative of a length of the suspension cables, information representative of a distance between the rotation axis and the suspension point, and information representative of a rotation speed of the suspension point, and using as an internal variable an acceleration of the first sway angle.

13. The control method as claimed in claim 12, wherein the calculation determines the first sway angle and the speed of the first sway angle by an iterative process using the acceleration of the first sway angle.

14. The control method as claimed in claim 13, wherein the calculation determines the first sway angle of the load by also taking into account the translation movement made by the suspension point along the translation axis.

15. The control method as claimed in claim 13, further comprising a correction that calculates an offset value of the first sway angle which is proportional to the rotation speed of the suspension point and which delivers a first correction signal for the speed of the translation movement of the suspension point which takes into account the offset value.

16. The control method as claimed in claim 15, wherein the first correction signal is proportional to the difference between the first sway angle and the offset value and is proportional to the speed of the first sway angle.

17. The control method as claimed in claim 16, wherein the first correction signal is added to a speed setpoint to supply a speed reference for the translation movement of the suspension point, the first correction signal being calculated by applying a correction coefficient to the difference between the first sway angle and the offset value and to the speed of the first sway angle.

18. The control method as claimed in claim 17, wherein the correction coefficients are variable as a function of the length of the suspension cables of the load.

19. The control method as claimed in claim 13, wherein the calculation determines a second sway angle of the load along a tangential axis perpendicular to the translation axis and a speed of the second sway angle, using as the only input variables the information representative of a length, the information representative of a distance, and the information representative of the rotation speed, and using as an internal variable an acceleration of the second sway angle.

20. The control method as claimed in claim 19, wherein the calculation determines the second sway angle and the speed of the second sway angle by an iterative process using the acceleration of the second sway angle.

21. The control method as claimed in claim 19, wherein the method further comprises a correction that supplies a second correction signal for the rotation speed calculated by applying a correction coefficient to the second sway angle and to the speed of the second sway angle.

22. The control method as claimed in claim 13, wherein the calculation uses a pendulum mathematical model with damping.

* * * * *